US007685035B2

(12) United States Patent
Aoki

(10) Patent No.: US 7,685,035 B2
(45) Date of Patent: Mar. 23, 2010

(54) NETWORK SYSTEM, SERVER APPARATUS, AND NETWORK MANAGEMENT PROGRAM

(75) Inventor: Isao Aoki, Tochigi (JP)

(73) Assignee: Panasonic Communications Co., Ltd., Tokyo (JP)

( * ) Notice: Subject to any disclaimer, the term of this patent is extended or adjusted under 35 U.S.C. 154(b) by 1709 days.

(21) Appl. No.: 10/649,651

(22) Filed: Aug. 28, 2003

(65) Prior Publication Data

US 2004/0083147 A1 Apr. 29, 2004

(30) Foreign Application Priority Data

Oct. 24, 2002 (JP) ..... 2002-309463

(51) Int. Cl.
*G07F 19/00* (2006.01)

(52) U.S. Cl. ..... 705/34; 709/203; 707/10; 715/764

(58) Field of Classification Search ..... 705/34, 705/14; 709/203; 707/10, 516; 715/764
See application file for complete search history.

(56) References Cited

U.S. PATENT DOCUMENTS

| | | | | |
|---|---|---|---|---|
| 5,940,843 | A * | 8/1999 | Zucknovich et al. | 715/210 |
| 5,956,487 | A | 9/1999 | Venkatraman et al. | |
| 6,216,113 | B1 | 4/2001 | Aikens et al. | |
| 6,535,294 | B1 * | 3/2003 | Arledge et al. | 358/1.15 |
| 7,188,137 | B2 * | 3/2007 | Inoue et al. | 709/203 |
| 2002/0087470 | A1 | 7/2002 | Hayes et al. | |
| 2002/0167684 | A1 | 11/2002 | Kikuchi et al. | |

FOREIGN PATENT DOCUMENTS

| | | |
|---|---|---|
| EP | 0478347 | 4/1992 |
| JP | 11-196212 | 7/1999 |
| JP | 2000-209260 | 7/2000 |
| JP | 2000-347975 | 12/2000 |
| JP | 2001-96857 | 4/2001 |
| JP | 2001-225531 | 8/2001 |
| JP | 2001-245077 | 9/2001 |
| JP | 2001-344089 | 12/2001 |
| JP | 2002-67451 | 3/2002 |
| JP | 2003-99226 | 4/2003 |

OTHER PUBLICATIONS

English Language Abstract of JP 2002-67451.
English language Abstract of JP 2001-225531.
English language Abstract of JP 2001-96857.
English language Abstract of JP 2001-344089.
English language Abstract of JP 2000-347975.
English language Abstract of JP 2000-209260.
English language Abstract of JP 2003-99226.
English language Abstract of JP 2001-245077.
English language Abstract of JP 11-196212.

* cited by examiner

*Primary Examiner*—Vanel Frenel
(74) *Attorney, Agent, or Firm*—Greenblum & Bernstein, P.L.C.

(57) ABSTRACT

A network system is provided that connects, on the network, a plurality of devices having document processing functions, a plurality of clients instructing the devices on necessary job executions, and a server. The server includes a collection recorder that collects information of a job executed by a device to record the information as job data, and a count processor that counts jobs according to count parameters set by a client. A browser installed to the client can select a count parameter, direct the count process, and view the count results generated by the count process.

33 Claims, 14 Drawing Sheets input screen for job count conditions

Fig. 5

| Job type name | Content | Setup item |
|---|---|---|
| G3 FAX reception | FAX received with G3 mode | All pages, monochrome page, printed page, FAX reception page, FAX transmission page |
| G3 FAX transmission | FAX transmitted with G3 mode | FAX transmission page, FAX transmission time |
| IFAX reception | FAX received via Internet | FAX transmission page, printed page, FAX transmission time, job size, all pages, monochrome page |
| IFAX transmission | FAX transmitted via Internet | FAX transmission page, FAX transmission time |
| PC printout | Printout from PC | All page, printed page, monochrome page |
| PC scan | Scan retrieved by PC | PC scanning page |
| Copy | Copy | Monochrome page, all pages, printed page, PC scanning page |
| PC FAX reception | FAX received by PC | FAX reception page, FAX transmission time |
| PC FAX transmission | FAX transmitted from PC | FAX transmission time, FAX transmission page |
| Mailbox registration | Security printing | All pages, printed pages, monochrome page |
| Tandem (master) | Tandem transmission side | Monochrome page, all pages, printed page, PC scanning page |
| Tandem (slave) | Tandem reception side | All pages, printed page, monochrome page |
| Remote (master) | Remote transmission side | PC scanning page |
| Remote (slave) | Remote reception side | All pages, printed page, monochrome page |

Fig.6 screen for job count result back forward stop refresh address http://www.**.co.jp//** job history

* job history

*display item setting job count

* job count

* help

*log out job count > by group report count result by group back search conditions

| | |
|---|---|
| summary | by group |
| interval | 1-6-2002—1-10-2002 |
| job type | ALL |
| device | ALL |
| paper size | ALL |
| group | ALL |
| user | ALL |

*Group-01

| job type | device | pages | unit price | total |
|---|---|---|---|---|
| PC printing | development 1 | 10 | .25 | 2.5 |
| | development 1 | 20 | .20 | 4.0 |

Fig.7(A)

| group | user | device | pages | unit price | total |
|---|---|---|---|---|---|
| development 1 | Donna | print 1 | 10 | 0.25 | 2.5 |
| | | print 2 | 2 | 0.2 | 4 |
| | | user total | | | 6.5 |
| | Jessica | print 1 | 20 | 0.25 | 5 |
| | | user total | | | 5 |
| | Noriko | print 2 | 10 | 0.2 | 2 |
| | | print 3 | 4 | 0.1 | 0.4 |
| | | user total | | | 2.4 |
| | group total | | | | 13.9 |
| development 2 | Hirono | print 2 | 40 | 0.2 | 8 |
| | | user total | | | 8 |
| | group total | | | | 8 |
| job type total | | | | | 21.9 |

Fig.7(B)

| group | job type | user | pages | unit price | total |
|---|---|---|---|---|---|
| development 1 | PC printing | Donna | 10 | 0.25 | 2.5 |
| | | Jessica | 20 | 0.25 | 5 |
| | | job type total | | | 7.5 |
| | scanning | - | 10 | 0.2 | 2 |
| | | job type total | | | 2 |
| | Fax transmission | - | 4 | 0.1 | 0.4 |
| | | - | 6 | 0.1 | 0.6 |
| | | job type total | | | 1 |
| | group total | | | | 10.5 |
| development 2 | PC printing | job type total | | | 0 |
| | scanning | job type total | | | 0 |
| | Fax transmission | job type total | | | 0 |
| | group total | | | | 0 |
| device total | | | | | 10.5 |

Fig.7(C)

| job type | device | pages | unit price | total |
|---|---|---|---|---|
| PC printing | print 1 | 10 | 0.25 | 2.5 |
| | print 2 | 20 | 0.2 | 4 |
| | job type total | | | 6.5 |
| scanning | MFP1 | 10 | 0.1 | 1 |
| | job type total | | | 1 |
| Fax transmission | MFP1 | 10 | 0.2 | 2.0 |
| | MFP2 | 20 | 0.1 | 2 |
| | job type total | | | 4 |
| group total | | | | 11.5 |

Fig.7(D)

| job type | device | pages | unit price | total |
|---|---|---|---|---|
| PC printing | print 1 | 10 | 0.25 | 2.5 |
| | print 2 | 20 | 0.2 | 4 |
| | job type total | | | 6.5 |
| user total | | | | 6.5 |

screen for display item setting

Fig. 10

*: Required item

| *Item name | | Content |
|---|---|---|
| *Device name | | |
| *Log number | | Number that manages job data |
| *Group name | | Name that identifies groups |
| User name | | PC login name |
| Job ID | | Number that identifies jobs |
| Job name | | File name |
| Host name | | IP address |
| *Job type | | |
| Data type | | GDI/PCL/PS |
| I/F type | | Lpd/Parallel/IPP |
| Combined pages | | N in 1 (1, 2...) |
| Duplex printing | | Duplex (1, 2...) |
| Finishing type | | Punch/staple/saddle stitch |
| Color mode | | Color/Monochrome |
| Print quality | | 300/600dpi |
| Toner saver | | ON/OFF |
| Job status | | Error/cancel/normal completion |
| Job starting time | | |
| *Job ending time | | |
| *Total printed pages | | Total number of printed pages (Duplex: 2) |
| Total fed sheets | | Total number of fed sheets (Duplex: 1) |
| Total count number | | Total counted number of sheets |
| Total PC scanned pages | | Total number of pages scanned by PC |
| FAX transmission total pages | | Total number of pages transmitted by FAX |
| FAX reception total pages | | Total number of pages received by FAX |
| FAX transmission/reception total time | | Total time used by online communication for FAX transmission/reception |
| Paper tray 1 | Paper size | A4/B4/letter |
| | Paper type | Plane only |
| | Output pages | Number of pages (Duplex: 2) |
| | Output sheets | Number of sheets (Duplex: 1) |
| Paper tray 2 | The detail is same as paper tray 1. | |
| | . . . | . . . |
| LCT | The detail is same as paper tray 1. | |

screen for device information list screen for adding device information screen for export information list screen for adding export information

NETWORK SYSTEM, SERVER APPARATUS, AND NETWORK MANAGEMENT PROGRAM

BACKGROUND OF THE INVENTION

1. Field of the Invention

The present invention relates to a network system that calculates billing information from usage, via a server apparatus that manages use of a processing apparatus having document processing functions (e.g., facsimile transmission/reception, printing, scanning, copying). This invention also relates to a server apparatus that is employed for this type of network system, and a network management program that is employed for this type of server apparatus.

2. Description of Related Art

Conventionally, a network billing system has been introduced that calculates fees according to usage by collecting usage information of document processing devices (e.g., printer, facsimile, copier, multifunctional printer) by employing a calculation management apparatus connected to the network (Prior Art 1). In this network billing system, the calculation management apparatus obtains usage information of document processing devices via PCs, which are connected to the document processing devices. The calculation result from the calculation management apparatus is delivered to a certain PC at the user side.

Prior Art 1: Japanese Patent Laid Open 2002-67451

In an environment where a plurality of PCs and document processing devices are connected via a network, due to the recent increasing popularity of LAN, and where the document processing devices are accessed by a group of PCs, indefinite users randomly attempt to obtain usage status of each group. Such users would like a capability, by using a convenient terminal, to access the calculation management apparatus., and to obtain the calculation result sorted by appropriate parameters. However, the conventional network billing system cannot satisfy such users needs.

SUMMARY OF THE INVENTION

The present invention addresses the above-described problems. The purpose of the invention is to provide a network system, server apparatus, and network management program that enables users to easily obtain calculated results such as billing information that is sorted by appropriate parameters according to their needs, in an environment where a plurality of document processing devices are accessed by a group of PCs within the network.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein:

FIG. 5 illustrates an example of a job type specified from the input screen for job count conditions illustrated in FIG. 4;

FIG. 6 is a screen for job count result displayed at a client apparatus during the process for outputting count result of FIG. 3;

FIG. 7(A)-7(D) illustrates an example of a list of counted results displayed with the screen for job count result of FIG. 6;

FIG. 10 illustrates an example of settable display items on the screen for display item settings of FIG. 9;

DETAILED DESCRIPTION OF PREFERRED EMBODIMENTS

The embodiments of the present invention are explained in the following, in reference to the above-described drawings.

Figure 1:
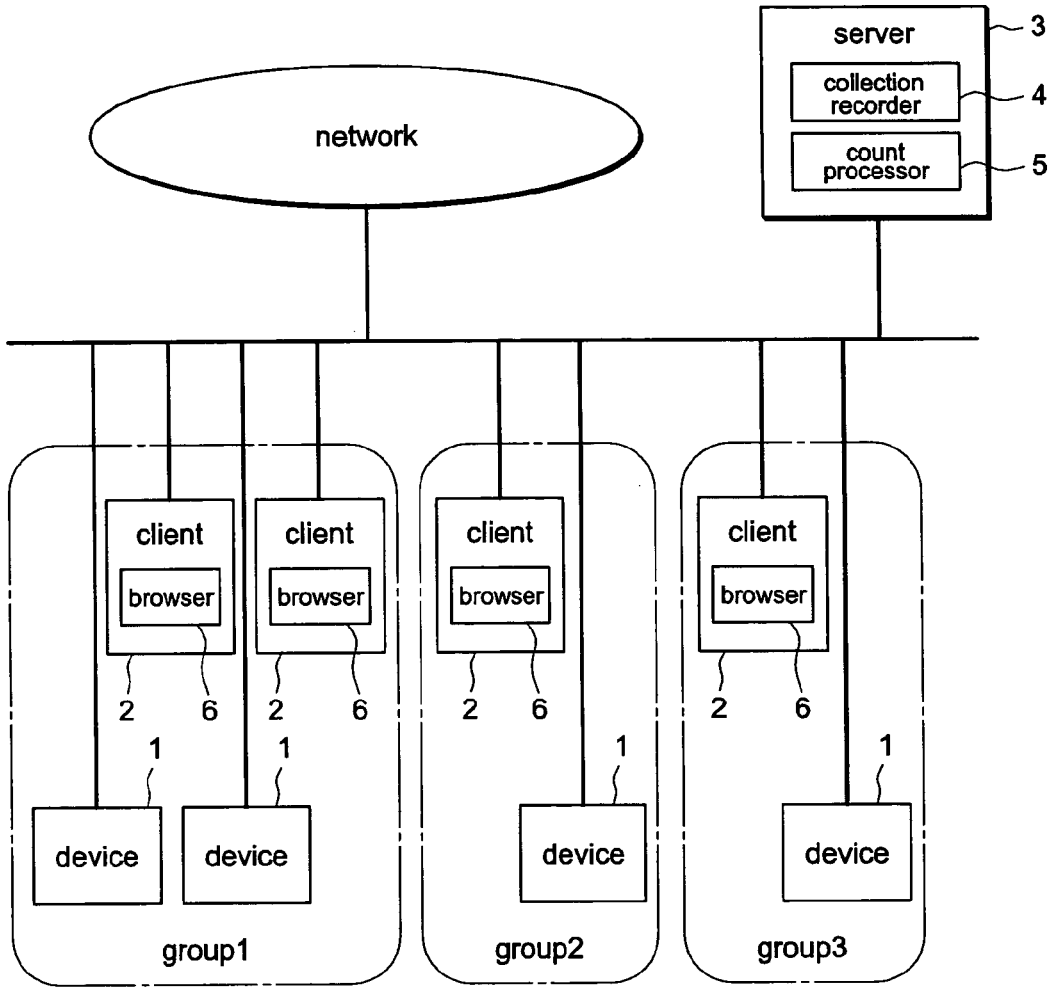
FIG. 1 is a block diagram illustrating a schematic configuration of a network system according to the present invention.

FIG. 1 is a block diagram illustrating a schematic configuration of a network system according to the present invention. In this network system, the network is connected to a plurality of devices (processing apparatuses) 1 that have document processing functions (e.g., facsimile transmitting/receiving, printing, scanning, and copying), a plurality of client apparatuses 2 that control devices 1 to execute necessary jobs, and a server apparatus 3. Devices 1 and client apparatuses 2 are grouped in accordance with units (e.g., departments) to which users belong.

Server apparatus 3 has collection recorder 4 that collects, from device 1, information of a job executed by device 1 and records the information as job data, and count processor 5 that performs a counting process according to a count condition specified by client apparatus 2 based on the job data. Browser 6 installed to client apparatus 2 can specify count conditions, instruct to execute a count process, and view the counted result generated by the counting process. Job data is generated per job unit executed by a device according to the direction given by client apparatus 2. Such job data includes device usage information such as a device name, executing time, user name, group name, and duplex printing.

In addition to a multifunctional printer that has a plurality of document processing functions, the device (processing apparatus) can have a single function such as a copier and a printer. Further, the server apparatus stores a network management program that executes necessary processes. The network management program retrieves recording media (e.g., CD-ROM) by using a retrieval apparatus and installs the data within the server apparatus. In this case, the network management program can be application software that operates on a general-purpose operation system. The client apparatus can also use a general-purpose browser without requiring a special program, thereby lowering the cost of introducing the system and simplifying the operation.

Figure 2A:
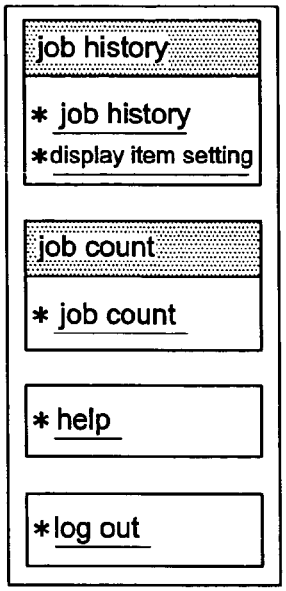
FIG. 2 illustrates menu columns displayed on a screen when a user logs into the system from a client apparatus of FIG. 1.
Figure 2B:
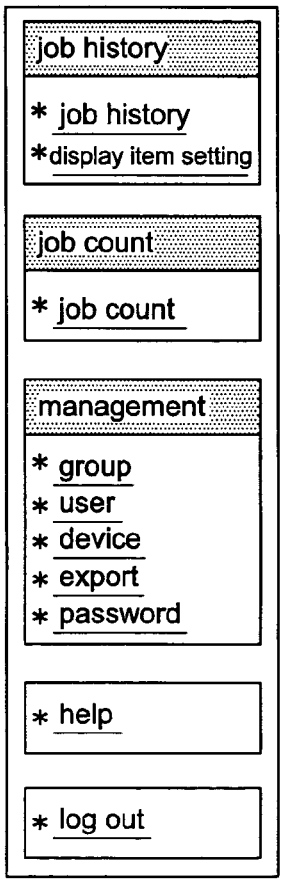

FIG. 2 illustrates menu columns on the displayed screen when the client apparatus of FIG. 1 logs into the system. The client apparatus can log into the system using an operator or manager mode. In operator mode (A), by selecting "job history" menu from "job history" sub-column, a list of job contents, which is based on the past recorded job data, can be displayed. In this embodiment, job data can be narrowed down using a targeted period, and an appropriate display condition for selected items, the necessary history information can be quickly retrieved.

By selecting "job count" menu from "job count" sub-column, count results (such as calculated fee information based on the job data) can be displayed. In this embodiment, count conditions can be specified according to the user's need (which is later described). For example, by setting a unit usage fee for each device, usage fee for each item can be calculated.

By selecting "display item setting" menu from "job history" sub-column, display items for displaying job history and job count processing results can be arranged. In this embodiment, necessary items can be selected from various information stored in job data (which is later described).

In manager mode (B), in addition to "job history" and "job count" sub-columns of the operator mode, "management" sub-column is provided, where menus such as "group", "user", "device", "export", and "password" are listed. "Group", "user", and "device" menus are provided to manage various groups, users, and devices, respectively, by registering/changing/deleting the same. "Export" menu can write out data (e.g., retrieval results from "job history" and count results from "job count") to a CSV file, in order to apply data to various database environments of users. "Password" menu can change a password for an operator/manager to log into the system.

Figure 3:
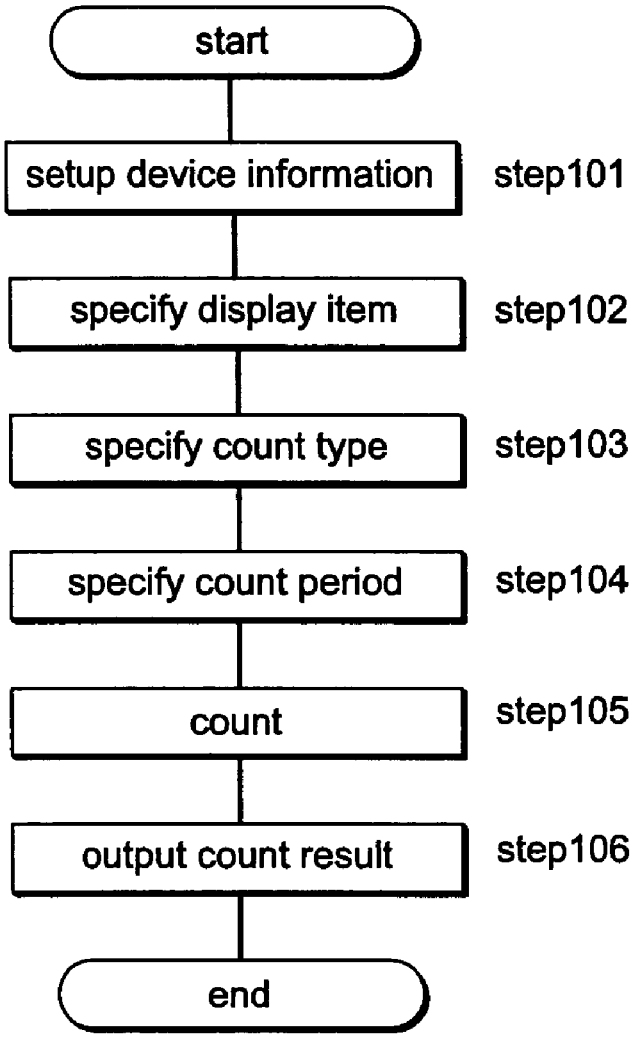
FIG. 3 is a flowchart illustrating a process performed by the network system of FIG. 1.

FIG. 3 is a flowchart illustrating the process of the network system of FIG. 1. At step 101, device information is setup using a bower of a client apparatus, which has logged into the system using a manager mode. The device information is stored in a server apparatus. This device information setting process is performed in an appropriate time, i.e., when the program is initially introduced and when changes need to be made. When usage information (e.g., fee information) needs to be obtained after starting the operation, the client apparatus (that has logged into the system with an operator/manager mode) specifies a display item from the browser at step 102, a count type at the following step 103, and a count period at step 104. When the count process is ordered from the client apparatus, the count process is executed at the count processor of the server apparatus at step 105, and the count result is displayed on the browser of the client apparatus at step 106.

Figure 4:
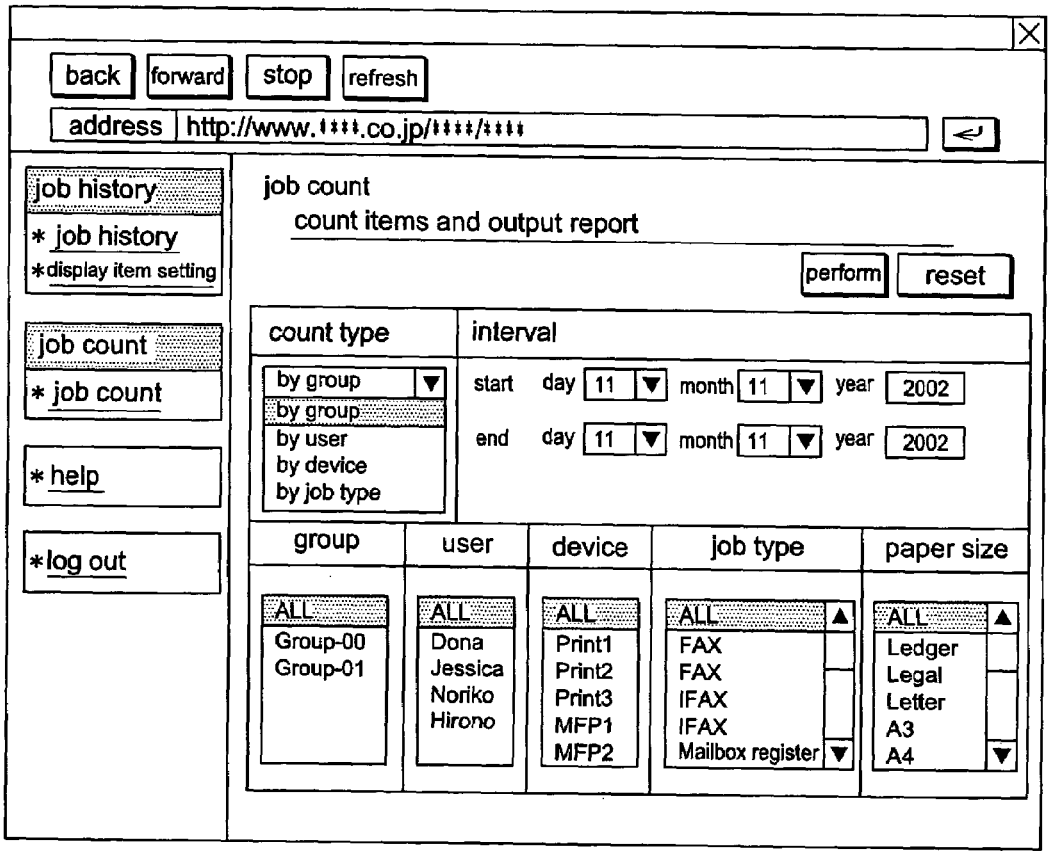
FIG. 4 illustrates an input screen for job count conditions that is displayed at a client apparatus when specifying a count type and count period illustrated in FIG. 3.

FIG. 4 illustrates an input screen for job count conditions that is displayed on the client apparatus upon specifying a count type (step 103) and count period (step 104) of FIG. 3. This input screen for job count conditions is used to specify count conditions for counting job data. This can be displayed by selecting "job count" menu from "job count" sub-columns within the menu column.

The count processor of the server apparatus performs the counting process by categorizing job data to be counted into the count type specified by the client apparatus. The client server can specify the desired count type from "count type" input field from the input screen for job count conditions. "Count type" can be selected from four categories: "by group", "by user", "by device" and "by job type".

When "by group" is selected, data is counted by each group of devices and client apparatuses, so that job data related to jobs performed by the devices within the group and to jobs ordered by the client apparatuses within the group is counted. When "by user" is selected, job data related to jobs instructed by each user (operating each client apparatus) is counted. When "by device" is selected, job data related to jobs performed by each device is counted. When "by job type" is selected, job data related to jobs in each category of job type is counted.

In addition, the count processor of the server apparatus can narrow down the job data to be counted based on the count period specified by the client apparatus. Thus, the user can specify starting and ending dates, according to his/her need, at "period" input field provided within the input screen for job count conditions. This narrowing down of job data specified by the count period is performed using a job ending time recorded in job data.

Further, the count processor of the server apparatus narrows down job data to be counted according to a count range selected, from a plurality of selections of count items, by the client apparatus. In this embodiment, "group", "user", "device", "job type", and "paper size" are provided as count item selections within the input screen for job count conditions, so that the count range can be defined according to the need. When the count range does not need to be defined, "ALL" can be selected.

FIG. 5 illustrates an example of job types specified on the input screen for job count conditions of FIG. 4. A job type is related to facsimile transmission/reception (e.g., G3 FAX reception, G3 FAX transmission, IFAX reception, IFAX transmission, PC FAX reception, and PC FAX transmission), printing (by PC), scanning (by PC), and copying. As a special process, the job type can include mailbox registration, tandem, and remote.

FIG. 6 illustrates a screen for job count result displayed on the client apparatus. during the count result output process of FIG. 3 (step 106). This screen for job count result is provided to confirm the count result, and can be displayed by pressing "perform" button after specifying count conditions such as count items and count period, on the input screen for job count conditions of FIG. 4. On this screen for job count result, the count conditions (specified from the input screen for job count conditions of FIG. 4) are displayed at the upper search condition area, while a list of count result is displayed below the search condition area. In order to display the count result with another count condition, "back" button can be pressed to return to the input screen of the job count conditions, where the count condition can be changed to restart the count process.

FIG. 7 illustrates examples of lists of count results that are displayed on the screen for job count result of FIG. 6. The count processor of the server apparatus generates a count result that includes numerical data stored in job data and calculated fee information based on the unit usage fee, which is preset for each job. The count result is displayed as the list that has columns of display items from the left, in the order of a display order. The inferior display items are embedded into the superior display items having calculated total fees.

List (A) is an example of selecting "by job type" as a count type. In this example, the display item columns are arranged in the order of "group", "user", and "device" from the left. In addition to the corresponding job type total, group unit total (group total), user unit total within the group (user total), sheets (of paper) per device for each user, unit price, and total fee are displayed. List (B) is an example of selecting "by device" as a count type. In this example, the display item columns are arranged in the order of "group", "job type", and "user" from the left. In addition to the corresponding device total, group unit total (group total), job type unit total within the group (job type total), sheets per user for each device, unit price, and total fee are displayed. List (C) is an example of selecting "by group" as a count type. In this example, the display item columns are arranged in the order of "job type" and "device" from the left. In addition to the corresponding group total, job type unit total (job type total), sheets per device for each job type, unit price, and total fee are displayed. List (D) is an example of selecting "by user" as a count type. In this example, the display item columns are arranged in the order of "job type" and "device" from the left. In addition to the corresponding user total, job type unit total (job type total), sheets per device for each job type, unit price, and total fee are displayed.

Figure 8:
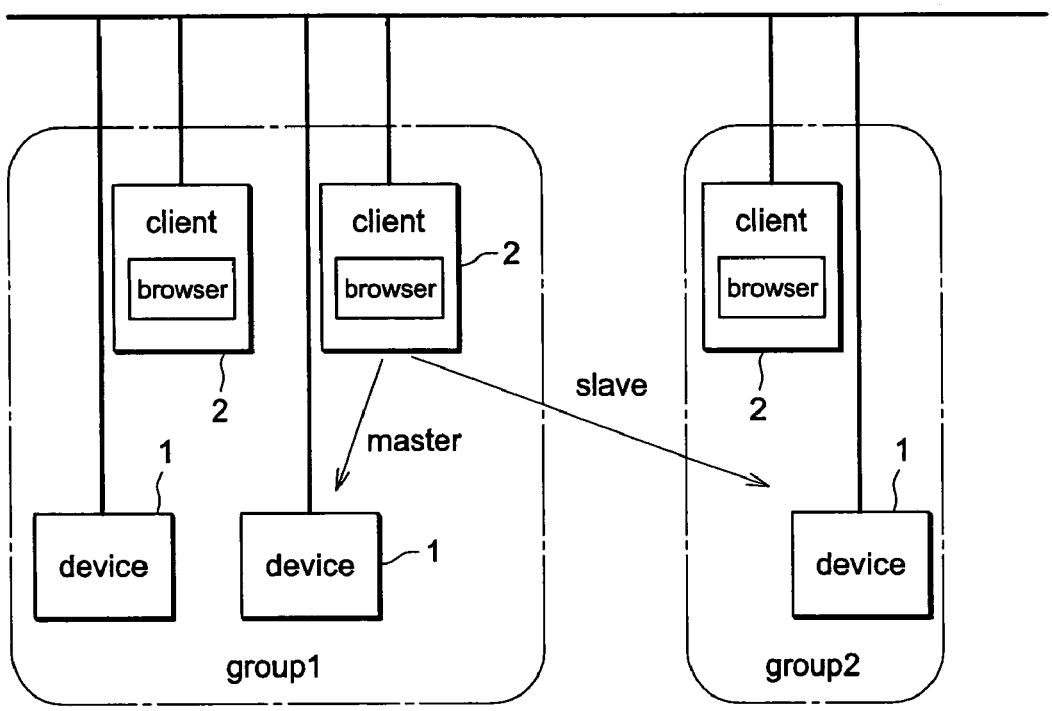
FIG. 8 illustrates a schematic diagram of a remote process that is one of job types of FIG. 5.

FIG. 8 illustrates a schematic diagram of a remote process that is one of job types of FIG. 5. The count processor of the server apparatus processes the fee information of a certain job by incorporating the information into a normal group to which the client group belongs, in case of a remote process that enables a device in a different group to perform the job. In this case, the device assigned to the client apparatus within the same group is considered as "master", and the specified device in a different group is considered as "slave". In addition, in case of a tandem process that enables a plurality of devices to perform a certain job, such plurality of devices are selected within a group to which the client apparatus belongs.

Figure 9:
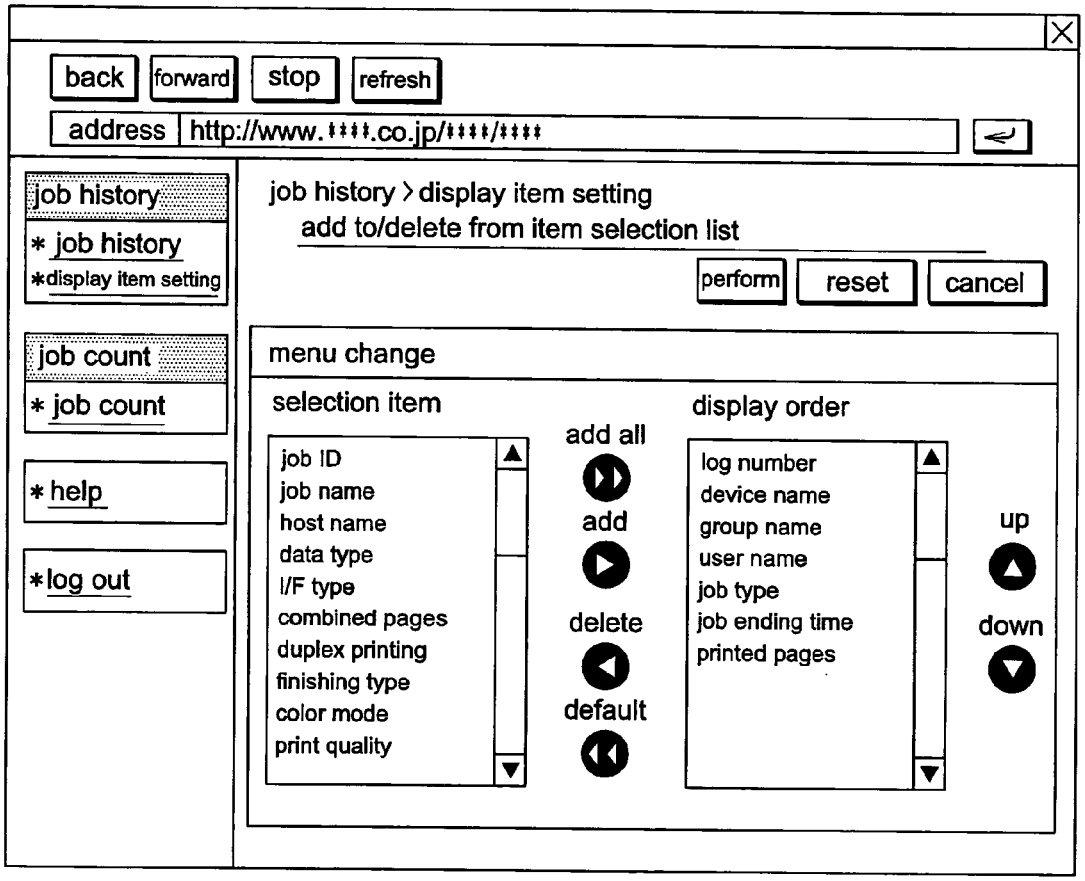
FIG. 9 is a screen for display item settings that is displayed at a client apparatus during the display item setting of FIG. 3.

FIG. 9 illustrates a screen for display item settings that is displayed on the client apparatus during the display item setting of FIG. 3 (step 102). This screen for display item settings is provided to change display items and their display order when displaying jobs as a list by selecting "job history" menu, and when displaying count results by selecting "job count" menu. This screen is displayed by selecting "display item setting" menu within "job history" sub-column within the menu column.

On this screen for display item settings, item names that do not need to be displayed are listed on the left side field within "menu change" frame. On the right side field, item names that need to be displayed are listed. By pressing "add all", "add", "delete", or "default" button, according to the need, an item name moves from the left to right field, or right to left field, so that the display setting can be changed according accordingly. For example, by selecting an item from the left field and pressing "add" button, the item can be displayed one at a time. Also, by pressing "add all" button, all items can be displayed all at once. In addition, by selecting an item from the right field and pressing "delete" button, the item can be removed from display one at a time. By pressing "default" button, only predetermined required items (e.g. log number, device name, group name, user name, job type, job ending time, and printed pages) can be displayed.

Further, on this screen for display item settings, to-be-displayed items are shown in the right side field in the order to be displayed. When "up" and "down" buttons are pressed according to the need, the display order of the items can be changed. For example, by selecting an item from the right field and pressing "up" button, the display order of the item is raised. On the contrary, by pressing "down" button, the display order of the item can be lowered. When selecting the display items and desired display order, the setting can be stored by pressing "perform" button.

FIG. 10 illustrates an example of display items that can be set on the screen for display item settings of FIG. 9. Such information related to items is stored in job data for each job. Basic display items include "device name", "group name", "user name", "host name", "log number", "job ID", "job name", and "job type". In addition, items relating to device usage include "data type", "I/F type", "combined pages", "duplex printing", "finishing type", "color mode", "print quality", "toner saver", "paper size of paper tray and LCT", "paper type", "output pages", and "output sheets". Further, item relating to device performance status include "job status", "job starting time", "job ending time", "total printed pages", "total fed sheets", "total count number", "total PC scanned pages", "Fax transmission total pages", "FAX reception total pages", and "FAX transmission/reception total time".

Figure 11:
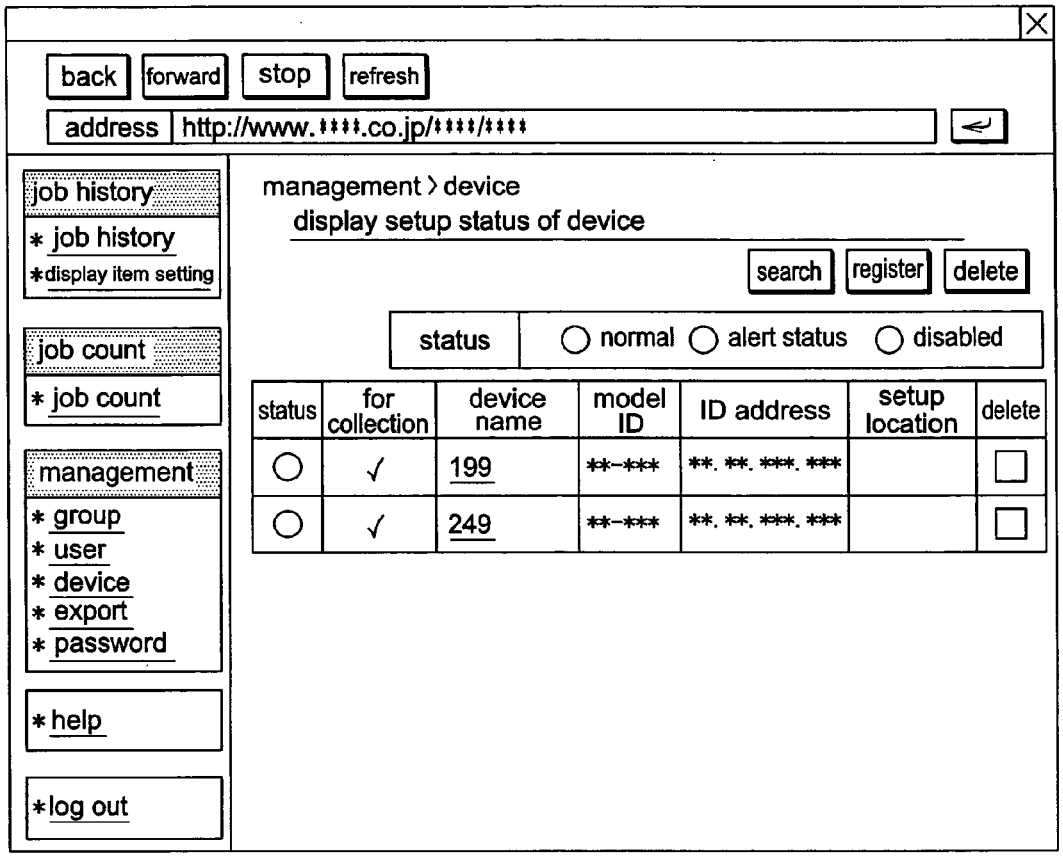
FIG. 11 illustrates a screen for device information list that is displayed by a client apparatus during the device management information setting of FIG. 3.

FIG. 11 illustrates a screen for device information list that is displayed at the client apparatus during the device management information setting of FIG. 3 (step 101). This screen for device information list is used to manage devices, including searching a specific device to change the setting and registering a new device. This screen can be displayed by selecting "device" menu from "management" in the displayed menu column in the management mode.

"Search" button is used to search all devices connected to the network and to display updated information. The search result is displayed as a list, in the lower area. providing various information for each device. "Register" button is used to register a new device. "Delete" button is to delete registry of a specific device.

A status icon display field within the search result list can display three icons: blue; yellow; and red, to indicate status of the corresponding device (normal, alert status, disabled, respectively). When the icon is norm-al, the device can be used and the job history process can be performed. When the icon is in an alert status, the device cannot be used but the job history process can be performed. When the icon is in a disabled status, the device cannot be used nor can the job history process be performed. In addition, when the device name is selected from the list, the screen changes into a screen for editing device information that changes setup information of a specific device.

Figure 12:
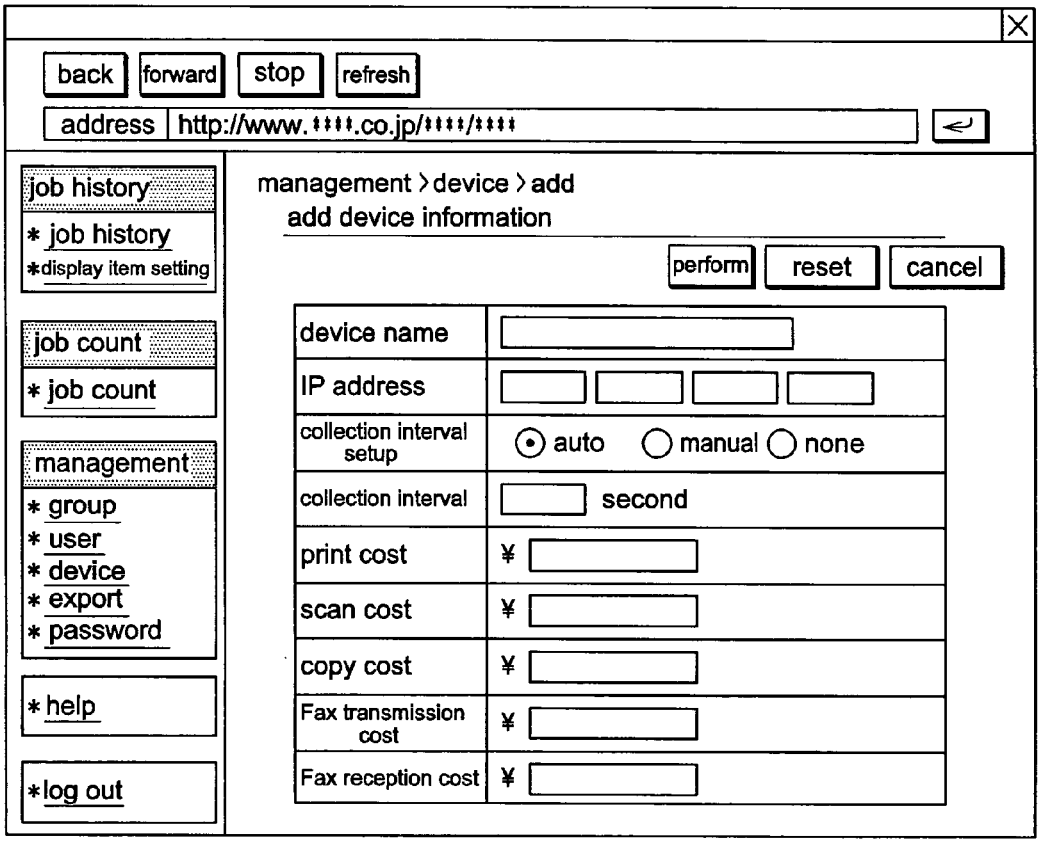
FIG. 12 illustrates a screen for adding device information that is displayed by a client apparatus during the device management information setting of FIG. 3.

FIG. 12 illustrates a screen for adding device information that is displayed at the client apparatus during the device management information setting of FIG. 3 (set 101). This screen for adding device information is used to register new device, and can be displayed by pressing "register" button on the screen for device information list of FIG. 11.

This screen for adding device information provides input fields such as "device name" of a newly registered device, "IP address" corresponding to the device, "collection interval setup" that specifies a method of setting time intervals of necessary information collected from the device in order to generate data, "collection interval" that specifies information collection interval, "print cost" that sets a unit printing cost per sheet, "scan cost" that sets a unit scanning cost per sheet, "copy cost" that sets a unit copying cost per sheet, "FAX transmission cost" that sets a unit fax transmission cost per sheet, and "FAX reception cost" that sets a unit fax reception cost per sheet. Upon inputting the above items, and when "perform" button is pressed, the new device information is added. "Collection interval setup" provides selection items such as "auto" that automatically sets the information collection interval according to the device capability, "manual" that allows the manager to manually set the interval and "none" that does not allow any information collection. When "manual" is selected, "collection interval" can be input.

Upon changing the device setup information after the registration process from the screen for adding device information, a necessary device name needs to be selected from the screen for device information list of FIG. 11. Then, a screen for editing device information, having similar items as the screen for adding device information, is displayed, where setup information can be changed for necessary items. Further, in addition to the input fields, the screen may include display fields such as model name, product name, manufacturer name, version, serial number, location, and printing speed, in order to provide convenience of being able to check the device specifications.

Figure 13:
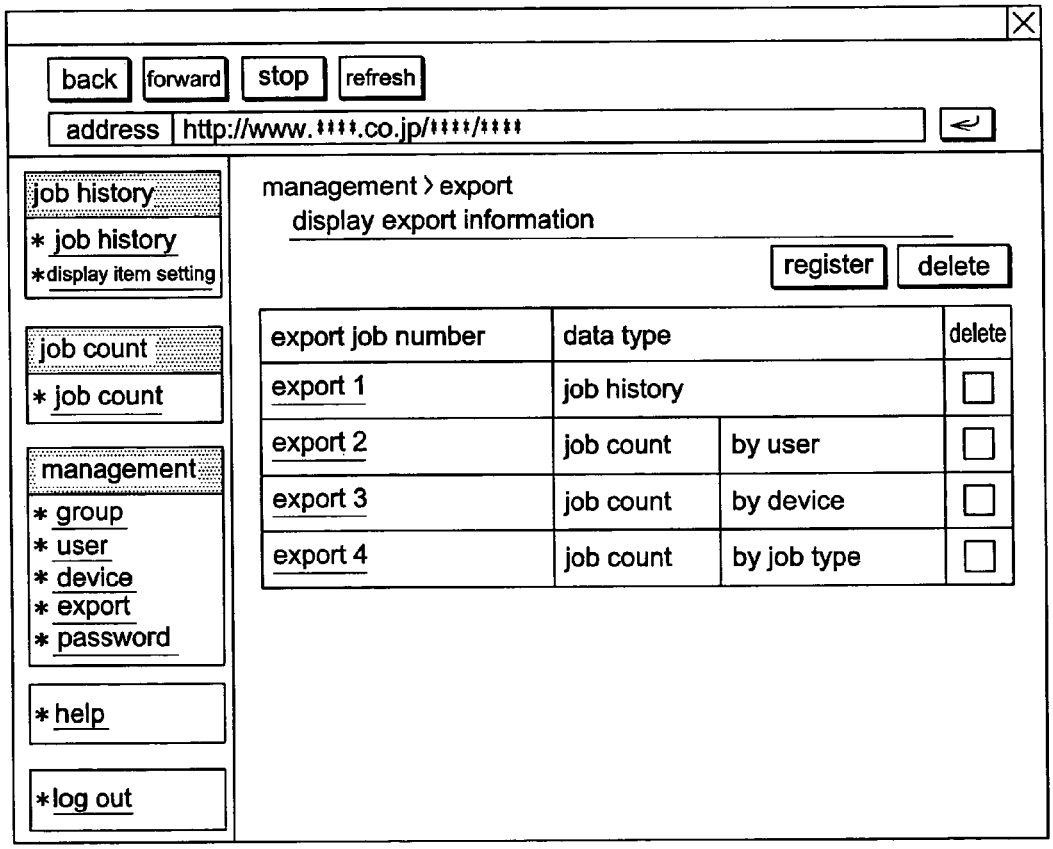
FIG. 13 illustrates a screen for export information list that is displayed by the client apparatus of FIG. 1.

FIG. 13 illustrates a screen for export information list that is displayed at the client apparatus of FIG. 1. This screen for export information list is used to add, perform, change, and delete exporting jobs that write out data into a CSV file, data being generated from retrieving the job history and counting jobs. This screen can be displayed when "export" menu is selected from "management" sub-column that is displayed in the manager mode. The output CSV file can be easily integrated into various database systems of users, so that the users can fully utilize the retrieval result from the job history and job count result. In addition, the export process is managed by the export job, thereby making it easy to perform the export process under the same condition, and making it possible to have a periodical automatic output.

Figure 14:
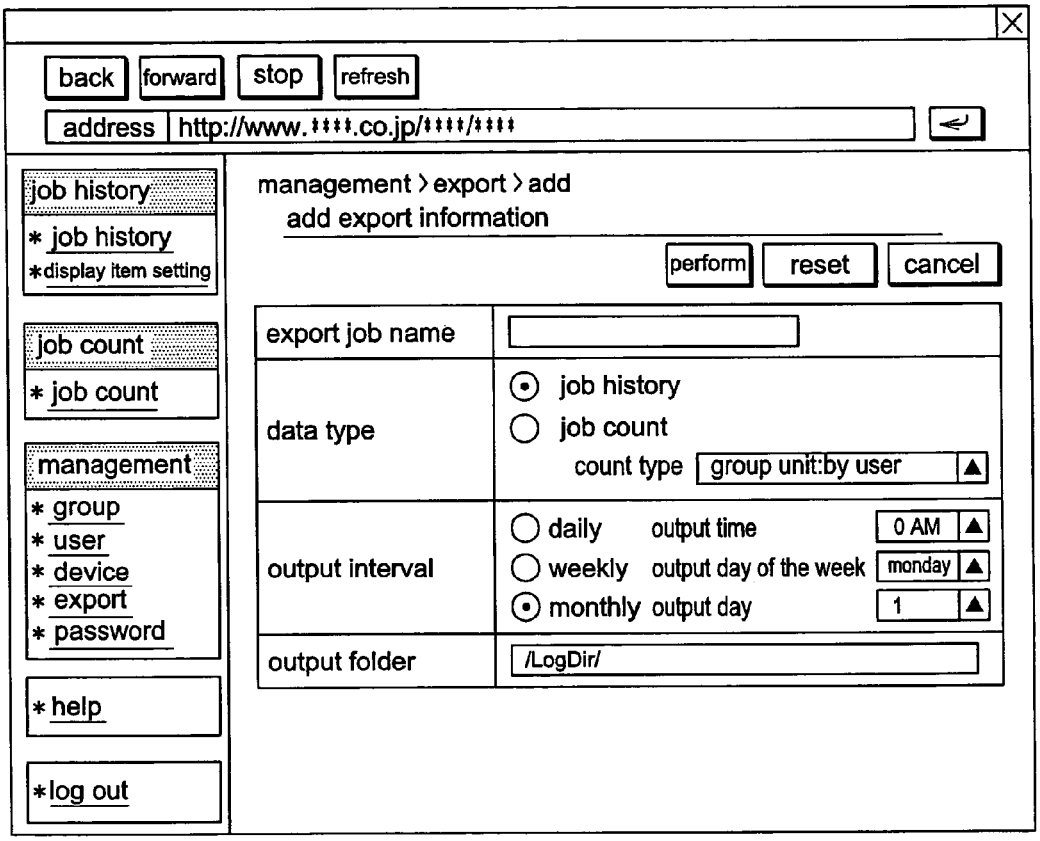
FIG. 14 illustrates a screen for adding export information that is displayed by the client apparatus of FIG. 1.

FIG. 14 illustrates a screen for adding export information that is displayed at the client apparatus of FIG. 1. This screen for adding export information is used to additionally register an export job to export in a new condition. The screen can be displayed by pressing "register" button on the screen for export information list of FIG. 13.

The screen provides input items for export information such as "export job name", "data type", "output interval", and "output folder". At "Data type", "job history" or "job count" is selected. When "job count" is selected, it enables a selection from "by job type", "by device" or "by group" in "count type" field. At "output interval", "daily", "weekly", or "monthly" can be selected as a periodical data export period. When "daily" is selected, exporting time needs to be selected. When "weekly" is selected, exporting day of the week needs to be selected. When "monthly" is selected, exporting day needs to be selected. At "output folder", a path is input to specify a location where the CSV file for exporting is stored. Upon completing the above input, "perform" button can be pressed to register the export job.

When the export job conditions need to be partially changed after performing the registration process at the screen for adding export information, a necessary export job name can be specified at the screen for export information list of FIG. 13. Then, the screen for editing export information, having the similar items as the screen for adding export information, can be displayed, where changes of setup for necessary items can be made from the screen for editing export information. At the screen for editing export information, "data type" and "output folder" items may be set as unchangeable but viewable items to confirm the setting.

Furthermore, in order to manually operate the registered export job, a certain button may be provided to be displayed on the screen for editing export information (by selecting the necessary export job name from the screen for export information list of FIG. 13). At this time, similar to the screen for display item setting of FIG. 9, a setting can be made where such output items and the order of output items can be specified. During the export of the job count, data can be output using the setup items shown in FIG. 5 for each job.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

This application is based on the Japanese Patent Application No. 2002-309463 filed on Oct. 24, 2002, entire content of which is expressly incorporated by reference herein.

What is claimed is:

1. A network system for determining billing fee usage information for document processing related jobs, comprising:

a plurality of processing apparatuses having document processing functions, each processing apparatus belonging to one of a plurality of groups;

a plurality of client apparatuses configured to instruct each of the processing apparatuses to execute a necessary document processing related job, each client apparatus belonging to one of the plurality of groups; and a server apparatus, all of said plurality of processing apparatuses and all of said plurality of client apparatuses being mutually connected on a network, wherein said server apparatus comprises a collection recorder that collects, from each of said plurality of processing apparatuses, information about a document processing related job executed by each of said processing apparatuses and records the information as job data, and a count processor that executes a count process according to a count condition specified by each of said plurality of client apparatuses, based on the job data, wherein a browser is installed to each client apparatus of the plurality of client apparatuses in order to specify the count condition, instruct an execution of the count process, and view a count result generated by the count processor, wherein, when performing a remote process where a certain document processing related job executed by using one of the plurality of processing apparatuses within a group different from a normal group to which a client apparatus belongs, the count processor of said server apparatus executes the count process by incorporating billing fee usage information of the document processing related job into the normal group, and wherein the normal group is a group where a processing apparatus that executes a document processing related job and a client apparatus that instructs the processing apparatus to execute the document processing related job are included in the same group.

2. The network system according to claim 1, wherein the count processor of said server apparatus executes a count process by classifying job data to be counted, according to a count type chosen and specified by a client apparatus, the count type being chosen from a prearranged plurality of count types.

3. The network system according to claim 2, wherein the count type is used when counting jobs by groups of processing apparatuses and client apparatuses, and wherein jobs executed by a processing apparatus of a certain group and job data related to jobs instructed by a client apparatus of the certain group are to be counted for each group.

4. The network system according to claim 2, wherein the count type is used when counting jobs by users who operate said plurality of client apparatuses, and wherein job data related to jobs instructed by a certain user are to be counted for each user.

5. The network system according to claim 2, wherein the count type is used when counting job types by said plurality of processing apparatuses, and wherein job data related to jobs executed by a certain processing apparatus are to be counted for each processing apparatus.

6. The network system according to claim 2, wherein the count type is used when counting jobs by job types, and wherein job data related to jobs within a certain job type are to be counted for each job type.

7. The network system according to claim 1, wherein the count processor of said server apparatus executes a count process by narrowing down job data for counting, based on a count period specified by a client apparatus.

8. The network system according to claim 1, wherein the count processor of said server apparatus executes a count process by narrowing down job data for counting, based on a count range selected, from a plurality of prearranged selections of count items, by a client apparatus.

9. The network system according to claim 8, wherein the count items include a group, a user, a job type, a processing apparatus, and a paper size.

10. The network system according to claim 1, wherein the count processor of said server apparatus generates a count result that includes a numeric value stored in job data, and fee information calculated based on a unit usage fee set for each job.

11. The network system according to claim 10, wherein the unit usage fee is set based on an instruction given by said client apparatus in a manager mode.

12. A server apparatus for determining billing fee usage information for document processing related jobs, connected on a network to a plurality of processing apparatuses having document processing functions and a plurality of client apparatuses instructing each of the plurality of processing apparatuses to execute a necessary document processing related job, each client apparatus and each processing apparatus belonging to one of a plurality of groups, the server apparatus comprising:

a collection recorder that collects from each of the plurality of processing apparatuses, information about a document processing related job executed by each of the processing apparatuses and records the information as job data; and a count processor that executes a count process according to a count condition specified by each of said plurality of client apparatuses, based on the job data, wherein a browser is installed to each client apparatus in order to specify the count condition, instruct an execution of the count process, and view a count result generated by each count process, wherein, when performing a remote process where a certain document processing related job executed by using one of the plurality of processing apparatuses within a group different from a normal group to which the client apparatus belongs, said count processor executes the count process by incorporating fee information of the document processing related job into the normal group, and wherein the normal group is a group where a processing apparatus that executes a document processing related job and a client apparatus that instructs the processing apparatus to execute the document processing related job are included in the same group.

13. The server apparatus according to claim 12, wherein said count processor executes a count process by classifying job data to be counted, according to a count type chosen and specified by a client apparatus, the count type being chosen from a prearranged plurality of count types.

14. The server apparatus according to claim 13, wherein the count type is used when counting jobs by groups of processing apparatuses and client apparatuses, and wherein jobs executed by a processing apparatus of a certain group and job data related to jobs instructed by a client apparatus of the certain group are to be counted for each group.

15. The server apparatus according to claim 13, wherein the count type is used when counting jobs by users who operate the plurality of client apparatuses, and wherein job data related to jobs instructed by a certain user are to be counted for each user.

16. The server apparatus according to claim 13, wherein the count type is used when counting jobs by the plurality of processing apparatuses, and wherein job data related to jobs executed by a certain processing apparatus are to be counted for each processing apparatus.

17. The server apparatus according to claim 13, wherein the count type is used when counting jobs by job types, and wherein job data related to jobs within a certain job type are to be counted for each job type.

18. The server apparatus according to claim 12, wherein said count processor executes a count process by narrowing down job data for counting, based on a count period specified by a client apparatus.

19. The server apparatus according to claim 12, wherein said count processor executes a count process by narrowing down job data for counting, based on a count range selected, from a plurality of prearranged selections of count items, by a client apparatus.

20. The server apparatus according to claim 19, wherein the count items include a group, a user, a job type, a processing apparatus, and a paper size.

21. The server apparatus according to claim 12, wherein said count processor generates a count result that includes a numeric value stored in job data, and fee information calculated based on a unit usage fee set for each job.

22. The server apparatus according to claim 21, wherein the unit usage fee is set based on an instruction given by the client apparatus in a manager mode.

23. A network management method for determining billing fee usage information for document processing related jobs for a server apparatus, connected on a network to a plurality of processing apparatuses having document processing functions, and a plurality of client apparatuses instructing each of the plurality of processing apparatuses to execute a necessary document processing related job, each client apparatus and each processing apparatus belonging to one of a plurality of groups, the method comprising:

collecting and recording, from each of the processing apparatuses, information about a document processing related job executed by the plurality of processing apparatuses and recording the information as job data; and executing a count process according to a count condition specified by each client apparatus, based on the job data, wherein a browser is installed to each client apparatus in order to specify the count condition, instruct an execution of the count process, and view a count result generated by the count process, wherein, when performing a remote process where a certain document processing related job executed by using one of the plurality of processing apparatuses within a group different from a normal group to which a client apparatus belongs, the count process is executed by incorporating fee information of the document processing related job into the normal group, and wherein the normal group is a group where a processing apparatus that executes a document processing related job and a client apparatus that instructs the processing apparatus to execute the document processing related job are included in the same group.

24. The network management method according to claim 23, wherein executing a count process executes a count process by classifying job data to be counted, according to a count type chosen and specified by a client apparatus, the count type being chosen from a prearranged plurality of count types.

25. The network management method according to claim 24, wherein the count type is used when counting jobs by groups of processing apparatuses and client apparatuses, and wherein jobs executed by a processing apparatus of a certain group and job data related to jobs instructed by a client apparatus of the certain group are to be counted for each group.

26. The network management method according to claim 24, wherein the count type is used when counting jobs by users who operate the plurality of client apparatuses, and wherein job data related to jobs instructed by a certain user are to be counted for each user.

27. The network management method according to claim 24, wherein the count type is used when counting jobs by the plurality of processing apparatuses, and wherein job data related to jobs executed by a certain processing apparatus are to be counted for each processing apparatus.

28. The network management method according to claim 24, wherein the count type is used when counting jobs by job types, and wherein job data related to jobs within a certain job type are to be counted for each job type.

29. The network management method according to claim 23, wherein executing a count process executes a count process by narrowing down job data for counting based on a count period specified by a client apparatus.

30. The network management method according to claim 23, wherein executing a count process executes a count process by narrowing down job data for counting, based on a count range selected, from a plurality of prearranged selections of count items, by a client apparatus.

31. The network management method according to claim 30, wherein the count items include a group, a user, a job type a processing apparatus, and a paper size.

32. The network management method according to claim 23, wherein executing a count process generates a count result that includes a numeric value stored in job data, and fee information calculated based on a unit usage fee set for each job.

33. The network management method according to claim 32, wherein the unit usage fee is set based on an instruction given by a client apparatus in a manager mode.

* * * * *